US005704566A

United States Patent [19]

Schutz et al.

[11] Patent Number: 5,704,566

[45] Date of Patent: Jan. 6, 1998

[54] PAPER TOWEL ROLL WITH VARIEGATED PERFORATIONS

[75] Inventors: Rudolph W. Schutz, Fort Bragg; John R. Moody, Antioch, both of Calif.

[73] Assignee: James River Corporation of Virginia, Richmond, Va.

[21] Appl. No.: 615,354

[22] Filed: Mar. 13, 1996

Related U.S. Application Data

[63] Continuation-in-part of Ser. No. 550,931, Oct. 31, 1995, Pat. No. 5,630,526.

[51] Int. Cl.[6] ..... B65H 35/10

[52] U.S. Cl. ..... 242/595; 242/160.1; 428/43

[58] Field of Search ..... 242/160.1, 160.4, 242/595; 225/52; 428/43

[56] References Cited

U.S. PATENT DOCUMENTS

| | | | |
|---|---|---|---|
| 3,986,479 | 10/1976 | Bonk | 225/52 |
| 4,457,964 | 7/1984 | Kaminstein . | |
| 4,627,117 | 12/1986 | Morishita . | |
| 5,041,317 | 8/1991 | Greyvenstein . | |
| 5,205,454 | 4/1993 | Schutz et al. . | |
| 5,236,753 | 8/1993 | Gaggero et al. . | |
| 5,266,371 | 11/1993 | Sugii et al. . | |
| 5,335,811 | 8/1994 | Morand | 221/45 |
| 5,496,605 | 3/1996 | Augst et al. | 428/43 |
| 5,526,964 | 6/1996 | Jones | 428/43 |
| 5,616,387 | 4/1997 | Augst et al. | 428/43 |
| 5,630,526 | 5/1997 | Moody | 221/45 |

FOREIGN PATENT DOCUMENTS

| | | | |
|---|---|---|---|
| 27 06 234 | 8/1978 | Germany | 428/43 |

*Primary Examiner*—John P. Darling
*Attorney, Agent, or Firm*—Thomas R. Lampe

[57] ABSTRACT

A roll of paper toweling is dispensed from the opening of a dispenser due to a manual pulling force applied to the toweling. The toweling is separated into a plurality of toweling segments by a plurality of spaced tear lines, the tear lines being straight, parallel to each other, and extending orthogonally relative to the side edges of the paper toweling. The perforated tear lines are formed of a plurality of spaced, elongated, axially aligned slits separated by frangible toweling portions extending between the slits. The frangible toweling portions are narrower near the side edges of the toweling than in the middle thereof and the distances between the centers of the toweling portions are substantially the same along the length of the perforated tear line.

9 Claims, 1 Drawing Sheet

PAPER TOWEL ROLL WITH VARIEGATED PERFORATIONS

This application is a continuation-in-part of U.S. patent application Ser. No. 08/550,931, filed Oct. 31, 1995 now U.S. Pat. No. 5,630,526.

TECHNICAL FIELD

This invention relates to a paper toweling roll having individual toweling segments separated by lines of perforations, the perforations in each line thereof being varied. The invention has particular application to the manual dispensing of individual paper towels from a roll of the towels housed in a dispenser cabinet.

BACKGROUND ART

Many dispenser devices exist in the prior art for dispensing paper toweling and the like. Quite often, dispensing is from a roll of toweling, which may be either perforated or non-perforated, the dispenser operative to promote or cause tearing of individual towel segments from the roll.

U.S. Pat. No. 5,335,811, issued Aug. 9, 1994, discloses a dispenser for dispensing individual sheets of perforated paper toweling from a roll thereof. The dispenser includes a casing with a mounting for the roll in its upper portion and an outlet at the bottom. The outlet is substantially narrower than the width of the toweling. A roller is mounted in the casing for guiding toweling from the roll mounting to the outlet.

The roller purportedly maintains the toweling at its full width. The toweling is gathered inwardly when passing from the roller to the outlet. According to the patent, upon pulling of the toweling out of the dispenser, the toweling begins to tear inwardly from its edges along a first line of perforations as the first line of perforations passes over the roller to separate a sheet from the remainder of the toweling.

My co-pending U.S. patent application Ser. No. 08/550,931, filed Oct. 31, 1995, now U.S. Pat. No. 5,630,526, discloses a paper towel dispenser cabinet for dispensing individual paper towels from a roll of paper toweling having a plurality of perforated tear lines dividing the paper toweling into a plurality of individual towel segments. The system discloses a housing having a sheet material dispensing opening with a width less than the distance between the side edges of the roll of paper toweling or other sheet material within the housing whereby the edges of the end-most segment of the roll of sheet material are engaged and move toward one another by the housing at opposed ends of the sheet material dispensing opening. The end-most segment is constricted when the end-most segment is received by and projects from the sheet material dispensing opening. The application also discloses the general concept of employing variegated perforations in the perforation tear lines of sheet material being dispensed.

It is also known in the prior art generally to employ perforated lines in sheet material such as paper toweling incorporating variegated perforations and, of course, use of perforated tear lines in rolls of sheet material such as paper toweling is a widely employed, well known expedient per se.

The following patents are believed to be representative of the state of the prior art in this field: U.S. Pat. No. 5,205,454, issued Apr. 27, 1993, U.S. Pat. No. 4,457,964, issued Jul. 3, 1984, U.S. Pat. No. 5,236,753, issued Aug. 17, 1993, U.S. Pat. No. 5,266,371, issued Nov. 30, 1993, U.S. Pat. No. 5,041,317, issued Aug. 20, 1991, U.S. Pat. No. 4,627,117, issued Dec. 9, 1986, and German Patent Publication DT 27 06 234.

The latter publication is worthy of particular comment in that it discloses perforation lines of variegated holes formed in the sheet. The diameters of the holes increase toward the edges of the paper. The publication also generally suggests decreasing the interval between holes at an edge to facilitate tearing of the perforated paper by one hand.

DISCLOSURE OF INVENTION

The present invention encompasses a roll of paper toweling having a plurality of spaced perforated tear lines dividing the paper toweling into a plurality of paper toweling segments. The perforated tear lines are comprised of variegated perforations of a specific character which make the roll of paper toweling particularly applicable for use with a dispenser cabinet of the type disclosed in my co-pending U.S. patent application Ser. No. 08/550,931, filed Oct. 31, 1995, now U.S. Pat. No. 5,630,526. The individual toweling segments are readily and reliably separated simply due to manual pulling of an end-most or terminal paper toweling segment projecting outwardly from the dispenser.

The roll of paper toweling constructed in accordance with the teachings of the present invention has side edges and is positionable in the interior of a dispenser for dispensing from the dispenser.

The paper toweling has a plurality of spaced perforated tear lines dividing the paper toweling into a plurality of paper toweling segments including an end-most paper toweling segment having a terminal end. The perforated tear lines are straight, parallel to each other, and extend between and orthogonally relative to the side edges of the paper toweling.

Each of the perforated tear lines comprises a plurality of spaced, elongated, axially aligned slits having uniform widths extending through the paper toweling and separated by frangible toweling portions extending therebetween.

The slits located at or closely adjacent to the side edges of the paper toweling are longer than the slits located at or closely adjacent to the middle of the paper toweling between the side edges.

The frangible toweling portions located at or closely adjacent to the side edges of the paper toweling are narrower than the frangible toweling portions located at or closely adjacent to the middle of the paper toweling between the side edges. The distances between the centers of adjacent frangible toweling portions are substantially the same along substantially the full length of the perforated tear line.

The present invention also encompasses a method of separating individual toweling segments from paper toweling of the aforesaid character and employment of the roll of paper toweling in combination with a paper towel dispenser.

Other features, advantages, and objects of the present invention will become apparent with reference to the following description and accompanying drawings.

BEST MODE FOR CARRYING OUT THE INVENTION

Figure 2:
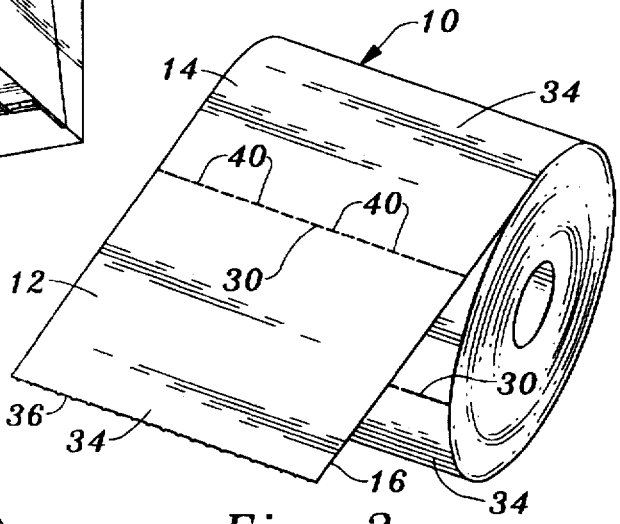
FIG. 2 is a perspective view illustrating a roll of paper toweling constructed in accordance with the teachings of the present invention.

Referring now to the drawings, and specifically FIG. 2, a roll of paper toweling constructed in accordance with the teachings of the present invention is designated by reference numeral 10. Roll 10 is formed from a wound web of paper toweling 12 shown in all drawing figures. The paper toweling has side edges 14, 16 and is positionable in the interior of a dispenser 20, the dispenser being illustrated only in FIGS. 3, 4 and 5. Dispenser 10 may suitably be the type of dispenser disclosed in my co-pending U.S. patent application Ser. No. 08/550,931, filed Oct. 31, 1995, now U.S. Pat. No. 5,630,526. The dispenser includes outlet walls 22, 24 defining an opening 26 communicating with the interior of the dispenser. Outlet walls 22, 24 are spaced apart a distance less than the distance between side edges 14, 16 of the paper toweling when the paper toweling is in flat condition.

Paper toweling 12 has a plurality of spaced perforated tear lines 30 dividing the paper toweling into a plurality of paper toweling segments 34 including an end-most paper toweling segment having a terminal end 36.

The perforated tear lines are of a specific character which facilitates separation of the end-most paper toweling segment from its adjoining following segment when dispensed from dispenser 20. The perforated tear lines 30 are straight, parallel to each other, and extend between and orthogonally relative to the side edges 14, 16 of the paper toweling.

Each of the perforated tear lines comprises a plurality of spaced, elongated, axially aligned slits 40 having substantially uniform widths extending through the paper toweling.

The slits 40 are separated by frangible toweling portions 46 extending therebetween.

The slits 40 located at or closely adjacent to the side edges of the paper toweling are longer than the slits located at or closely adjacent to the middle of the paper toweling between the side edges.

Figure 1:
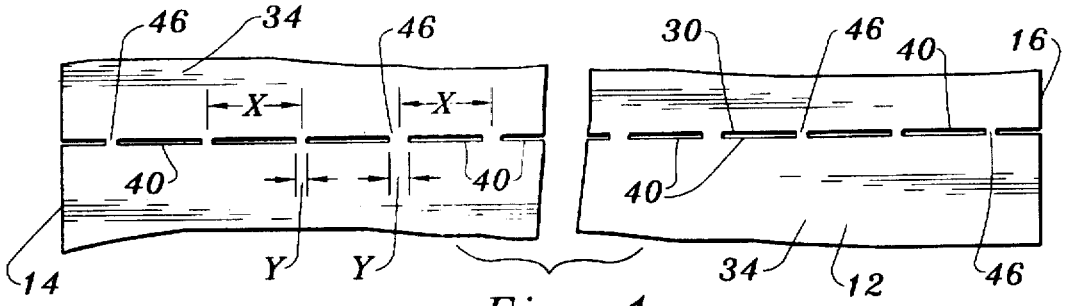
FIG. 1 is a plan view of a portion of paper toweling constructed in accordance with the teachings of the present invention illustrating a perforated tear line between adjoining paper toweling segments.

The frangible toweling portions 46 located at or closely adjacent to the side edges of the paper toweling are narrower than the frangible toweling portions located at or closely adjacent to the middle of the paper toweling between the side edges. Also very important is the fact that the distances between the centers of adjacent frangible toweling portions are substantially the same along substantially the full length of the perforated tear line. FIG. 1 illustrates these features with particular clarity. In FIG. 1 the dimension X relates to the distance between the centers of adjacent frangible toweling portions. As indicated above, distance X is substantially the same along the full length of the perforated tear line. This distance should fall within the range of from 3/16 inch to 5/16 inch in order for separation of the end-most toweling segment to occur in an advantageous manner at the dispenser.

The widths of the frangible toweling portions (dimension Y in FIG. 1) is within the range of from about 0.035 inch to about 0.060 inch. The lengths of the slits are within the range of from about 0.200 in. to about 0.3125 in.

Figure 3:
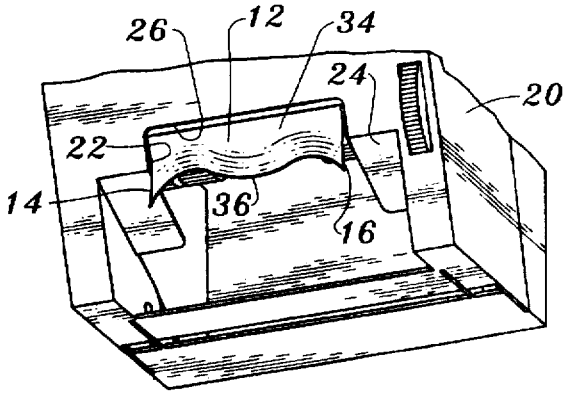
FIGS. 3–5 are perspective views of a portion of a paper towel dispenser and an end-most segment of a roll of paper toweling during consecutive stages of the dispensing operation.

When dispensing toweling from roll 10, the roll is placed within the interior of dispenser 20 and the end-most paper toweling segment 34 is inserted into and through opening 26 defined by dispenser outlet walls 22, 24. Since the paper toweling side edges are normally spaced apart a distance greater than the distance between the outlet walls, the outlet walls exert opposed compressive forces on the paper toweling side edges of the end-most paper toweling segment to urge the paper toweling side edges toward one another. The toweling, of course, then distorts from its normally flat condition. This is shown in FIG. 3.

While exerting the opposed compressive forces on the paper toweling side edges of the end-most paper toweling segment at the dispenser outlet walls, a pulling force is applied to the end-most paper toweling segment adjacent to the terminal end thereof in a direction substantially orthogonal to the opposed compressive forces to move the end-most paper toweling segments relative to the dispenser outlet walls. This is, of course, normally accomplished by the consumer manually grasping the end-most paper toweling segment adjacent to the terminal end thereof and pulling on the toweling. The outlet walls exert drag forces on the end-most paper toweling segment at the paper toweling side edges during movement of the end-most paper toweling segment to resist pulling thereof.

Figure 4:
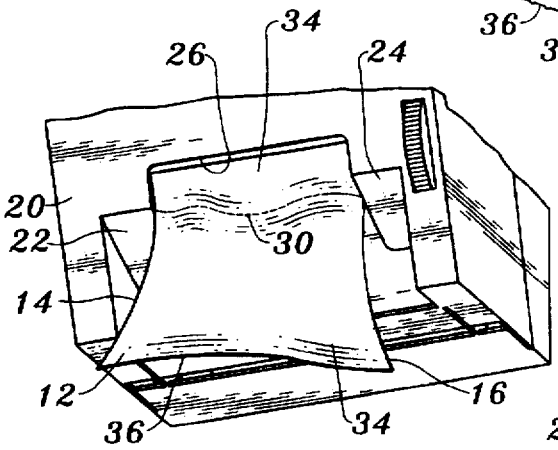

During movement of the end-most paper toweling segment, the perforated tear line 30 separating the end-most paper toweling segment from the adjoining and following paper toweling segment is brought into engagement with the dispenser outlet walls and then subsequently past the dispenser outlet walls. This stage of the operation is illustrated in FIG. 4. The pulling force, the opposed compressive forces and the drag forces cooperate to separate the end-most paper toweling segment from the adjoining, following segment.

Figure 5:
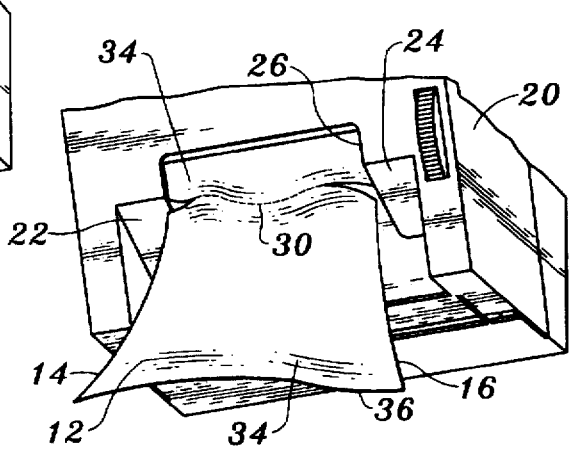

Because of the specific nature of the perforated tear line, such separation is initiated at the ends of the perforated tear line with the frangible toweling portions at or closely adjacent to the paper toweling side edges serially breaking from the outside inwardly. This is illustrated in FIG. 5. The effect is much the same as pulling a zipper apart simultaneously from two opposed ends thereof. The edge tension produced simultaneously at the outer edges of the paper toweling at the point of contact with the dispenser outlet walls insures such tearing action.

The stronger bonds at and adjacent to the middle of the paper toweling result in this portion of the web being the last to fail, separation being caused by the vertical tensions imparted to the toweling when the toweling width equals the distance between the outlet walls. By the time of complete separation, the terminal end of the adjoining, following toweling segment will extend from the dispenser opening, available for a new user to repeat the process.

We claim:

1. In combination:

a paper towel dispenser defining an interior and including outlet walls defining an opening communicating with said interior, said outlet walls being spaced apart; and a roll of paper toweling having side edges disposed within the interior of the paper towel dispenser for dispensing through said opening, said side edges being spaced apart a distance greater than the distance between said outlet walls, said paper toweling having a plurality of spaced perforated tear lines dividing said paper toweling into a plurality of paper toweling segments including an end-most paper toweling segment having a terminal end, said perforated tear lines being straight, parallel to each other, and extending between and orthogonally relative to the side edges of said paper toweling, each of said perforated tear lines comprising a plurality of spaced, elongated, axially aligned slits extending through said paper toweling and separated by frangible toweling portions extending therebetween, the slits located at or closely adjacent to the side edges of said paper toweling being longer than the slits located at or closely adjacent to the middle of said paper toweling between said side edges, the frangible toweling portions located at or closely adjacent to the side edges of said paper toweling being narrower than the frangible toweling portions located at or closely adjacent to the middle of said paper toweling between said side edges, and the distances between the centers of adjacent frangible toweling portions being substantially the same along substantially the full length of said perforated tear line.

2. The roll of paper toweling in the combination of claim 1 wherein the distance between the centers of adjacent frangible toweling portions is substantially the same and falls within the range of from about 3/16 in. to about 5/16 in.

3. The roll of paper toweling in the combination of claim 1 wherein the widths of said frangible toweling portions are within the range of from about 0.035 in. to about 0.060 in.

4. The roll of paper toweling in the combination of claim 1 wherein the lengths of said slits are within the range of from about 0.200 in. to about 0.3125 in.

5. A roll of paper toweling having side edges and positionable in the interior of a dispenser for dispensing from said dispenser, said paper toweling having a plurality of spaced perforated tear lines dividing said paper toweling into a plurality paper toweling segments including an endmost paper toweling segment having a terminal end, said perforated tear lines being straight, parallel to each other, and extending between and orthogonally relative to the side edges of said paper toweling, each of said perforated tear lines comprising a plurality of spaced, elongated, axially aligned slits extending through said paper toweling and separated by frangible toweling portions extending therebetween, the slits located at or closely adjacent to the side edges of said paper toweling being longer than the slits located at or closely adjacent to the middle of said paper toweling between said side edges, the frangible toweling portions located at or closely adjacent to the side edges of said paper toweling being narrower than the frangible toweling portions located at or closely adjacent to the middle of said paper toweling between said side edges, and the distances between the centers of adjacent frangible toweling portions being substantially the same along substantially the full length of said perforated tear line.

6. The roll of paper toweling according to claim 5 wherein the distance between the centers of adjacent frangible toweling portions is substantially the same and falls within the range of from about 3/16 in. to about 5/16 in.

7. The roll of paper toweling according to claim 5 wherein the widths of said frangible toweling portions are within the range of from about 0.035 in. to about 0.060 in.

8. The roll of paper toweling according to claim 5 wherein the lengths of said slits are within the range of from about 0.200 in. to about 0.3125 in.

9. The roll of paper toweling according to claim 5 wherein said slits have substantially uniform widths.

* * * * *